US008646237B1

(12) United States Patent
Takagi

(10) Patent No.: US 8,646,237 B1
(45) Date of Patent: Feb. 11, 2014

(54) SEALING RETENTION CLIP

(75) Inventor: Kyozaburo Takagi, Centerville, OH (US)

(73) Assignee: Fukuvi USA, Inc., Huber Heights, OH (US)

( * ) Notice: Subject to any disclaimer, the term of this patent is extended or adjusted under 35 U.S.C. 154(b) by 327 days.

(21) Appl. No.: 12/834,954

(22) Filed: Jul. 13, 2010

Related U.S. Application Data

(63) Continuation-in-part of application No. 10/756,002, filed on Jan. 13, 2004, now abandoned.

(60) Provisional application No. 60/523,031, filed on Nov. 18, 2003.

(51) Int. Cl.
*E04C 3/00* (2006.01)
*E04B 2/00* (2006.01)
*E04C 2/34* (2006.01)

(52) U.S. Cl.
USPC ..... 52/464; 52/584.1; 52/466; 52/506.05; 52/770

(58) Field of Classification Search
USPC ..... 52/459–470, 584.4, 716.8, 102, 506.05, 52/506.06, 507, 509, 483.1–489.2, 770
See application file for complete search history.

(56) References Cited

U.S. PATENT DOCUMENTS

| | | | | |
|---|---|---|---|---|
| 1,749,648 | A * | 3/1930 | Ray | 52/376 |
| 2,021,922 | A | 11/1935 | Peck | |
| 2,317,428 | A | 4/1943 | Anderson | |
| 2,348,658 | A * | 5/1944 | Slaughter | 52/717.05 |
| 2,394,443 | A | 2/1946 | Guignon, Jr. | |
| 2,781,109 | A | 2/1957 | Memmler | |
| 2,831,222 | A | 4/1958 | Anderson | |
| 3,293,813 | A | 12/1966 | Emmons et al. | |
| 3,349,533 | A | 10/1967 | Gregoire | |
| 3,420,029 | A | 1/1969 | Martin | |
| 3,571,987 | A * | 3/1971 | Anderson | 52/27 |
| 3,712,015 | A | 1/1973 | Nelson | |
| 3,732,660 | A * | 5/1973 | Byssing | 52/489.1 |
| 3,885,362 | A | 5/1975 | Pollock | |

(Continued)

FOREIGN PATENT DOCUMENTS

| | | | |
|---|---|---|---|
| GB | 2246386 | A | 1/1992 |
| WO | 0179620 | A1 | 10/2001 |
| WO | WO 0179620 | A1 * | 10/2001 |

*Primary Examiner* — Joshua J Michener
*Assistant Examiner* — Elizabeth A Plummer
(74) *Attorney, Agent, or Firm* — Dinsmore & Shohl LLP

(57) ABSTRACT

An insulated wall assembly including a plurality of pre-cast panels, a plurality of insulation panels, at least two J-shaped clips, and at least one I-shaped clip is provided. The precast panels may be oriented such that the adjacent vertical edges are in an abutting relationship to form a wall, and the J-shaped clips comprise a trough portion and a wall engaging portion. The I-shaped clip comprises two wall engaging portions and a two retention portions, and the wall engaging portions of the J-shaped clips each define a substantially planar wall-engaging surface capable of attaching to the wall. The wall-engaging portions of the I-shaped clip each define a substantially planar wall-engaging surface capable of attaching to the wall. The trough portion of the J-shaped clip comprises at least one pliant integral co-extruded seal extending away from a distal edge of the trough portion in an angled configuration, and each retention portion of the I-shaped clip includes at least one pliant integral co-extruded seal extending away from a distal edge of the retention portion in an angled configuration.

13 Claims, 5 Drawing Sheets

(56) References Cited

U.S. PATENT DOCUMENTS

| | | | | | |
|---|---|---|---|---|---|
| 3,950,900 | A | | 4/1976 | Simpson | |
| 3,958,372 | A | | 5/1976 | Benbow | |
| 4,067,155 | A | | 1/1978 | Ruff et al. | |
| 4,158,938 | A | | 6/1979 | Meechan et al. | |
| 4,214,412 | A | * | 7/1980 | Barylski | 52/169.12 |
| 4,299,069 | A | | 11/1981 | Neumann | |
| 4,370,838 | A | * | 2/1983 | Vermillion | 52/36.6 |
| 4,375,742 | A | | 3/1983 | Paliwoda | |
| 4,385,850 | A | | 5/1983 | Bobath | |
| 4,397,127 | A | * | 8/1983 | Mieyal | 52/241 |
| 4,459,790 | A | * | 7/1984 | Vermillion | 52/764 |
| 4,549,378 | A | * | 10/1985 | Ayers et al. | 52/169.12 |
| 4,635,422 | A | | 1/1987 | Nowack et al. | |
| 4,660,339 | A | * | 4/1987 | Paz | 52/238.1 |
| 5,070,667 | A | | 12/1991 | Schulte | |
| 5,086,602 | A | | 2/1992 | Pukas | |
| 5,417,020 | A | * | 5/1995 | Dobija | 52/235 |
| 5,433,053 | A | | 7/1995 | Tulloch | |
| 5,678,383 | A | | 10/1997 | Danielewicz | |
| 5,946,874 | A | | 9/1999 | Roberts | |
| 6,076,322 | A | | 6/2000 | D'Andrea et al. | |
| 6,158,915 | A | * | 12/2000 | Kise | 403/309 |
| 6,219,982 | B1 | | 4/2001 | Eyring | |
| 6,374,552 | B1 | | 4/2002 | Price | |
| 6,389,759 | B2 | | 5/2002 | McGrath et al. | |
| 6,588,165 | B1 | | 7/2003 | Wright | |
| 7,207,147 | B2 | | 4/2007 | Price et al. | |
| 7,299,595 | B1 | | 11/2007 | Anderson, Sr. | |
| 7,845,120 | B2 | * | 12/2010 | Thome et al. | 52/144 |
| 8,011,146 | B2 | * | 9/2011 | Krause | 52/235 |
| 8,020,352 | B2 | * | 9/2011 | Ahearn | 52/242 |
| 8,161,705 | B2 | * | 4/2012 | Pratt | 52/506.05 |
| 2006/0005486 | A1 | | 1/2006 | Robinson | |
| 2007/0068101 | A1 | | 3/2007 | Weir et al. | |
| 2009/0126305 | A1 | * | 5/2009 | Sareyka et al. | 52/483.1 |
| 2009/0199501 | A1 | * | 8/2009 | O'Riordan | 52/455 |
| 2010/0024339 | A1 | | 2/2010 | Tamlyn et al. | |
| 2012/0210657 | A9 | * | 8/2012 | Sanders et al. | 52/145 |
| 2013/0186027 | A1 | * | 7/2013 | Sharpe et al. | 52/506.05 |
| 2013/0232902 | A1 | * | 9/2013 | Mayer et al. | 52/483.1 |

* cited by examiner

SEALING RETENTION CLIP

This application is a continuation-in-part of U.S. application Ser. No. 10/756,002 filed Jan. 13, 2004 now abandoned, which claims the benefit of U.S. Provisional Application No. 60/523,031, filed Nov. 18, 2003.

BACKGROUND OF THE INVENTION

The present invention relates to retention clips mountable to wall panels to improve the ease with which these panels can have insulation or related structure mounted thereto.

Wall panels are some of the basic components of building structures, and come in various configurations, including preformed and assembled-on-site versions. One type of wall panel that has been used extensively in modern building structures involves the use of tilt-up, precast, cast-in-place, and other similar construction techniques, where uncured material (such as concrete) is introduced into a form and cured such that a panel in the shape of the form is produced. As used herein, a precast panel includes any panel that is formed from a cast material that upon curing hardens up, thereby allowing the panel to be subsequently placed in a desired (typically vertical) location within a building structure. A tilt-up panel is a particular type of precast panel that is formed on a horizontal surface and tilted up into place upon curing of the cast material. A need exists for securing insulation to these and related panels in a quick, inexpensive and repeatable fashion.

SUMMARY OF THE INVENTION

The present invention comprises a clip that includes sealed retention channels, such that when the clips are connected to precast wall panels (generally), tilt-up wall panels (specifically) or any other type of wall or surface to be insulated, they can hold insulation securely to the wall panel in such a way as to maximize the insulative properties of the wall. The clips are configured such that close tolerances, coupled with knife-edge seals, promote a secure fit with the insulation material and improved insulative properties of the wall panel-insulation material combination. The clips of the present invention can be disposed both horizontally and vertically on the wall panel, the former to support the weight of the insulation and the latter to adjoin adjacent insulation panels or enclose the edge of the insulation.

According to a first aspect of the invention, a retention clip is disclosed. The clip includes a panel engaging portion and a retention portion, where the panel engaging portion and retention portion together define at least one retention channel between them. The retention portion further includes at least one seal extending along a longitudinal dimension of the retention channel. The seal is configured such that it defines a channel entrance along the retention channel's longitudinal dimension; this channel entrance defines a throat-like channel access dimension that is smaller (or restrictive) relative to a parallel dimension of a remaining portion of the retention channel.

According to another aspect of the invention, a clip for securing insulation to a panel is disclosed. In the present context, it will be understood that insulation comes in various forms, and that any such form that includes rigid sheet or fibrous-based rolls (such as fiberglass) is envisioned as being compatible with the present invention. In addition, any generally planar sheet material with a thickness dimension properly engageable with the clip described herein would qualify as insulation by virtue of its ability to measurably reduce the transfer of heat to or from the panel relative to no sheet being present. The clip includes a panel-engaging portion with a corresponding panel-engaging surface, and a retention portion, configured to engage the insulation, coupled to the panel-engaging portion. The retention portion is made up of numerous walls that together define at least one retention channel, and one or more seals configured such that upon placement of the insulation into the channel, the seal engages the insulation.

In one form, the placement of the insulation into the channel causes the seal to be biased against the insulation to effect a secure fit between them. Moreover, the seal can be situated on a substantially distal end of the retention portion. In another option, the panel-engaging surface is substantially planar, while in yet another, the clip is of unitary construction. The panel-engaging portion is elongate relative to the retention portion in at least one dimension such that an attachment-receiving tab is defined therein. The attachment-receiving tab can accept adhesives thereon or fasteners therethrough, such as screws, nails, rivets or the like. In the relatively elongate configuration, the tab extends such that a substantially outward-facing normal projection from a surface on the tab does not intersect the plurality of walls of the retention portion, thereby facilitating substantially unimpeded access of a fastener to the clip to retain the clip on the panel. The tab may additionally include an aperture to facilitate the receipt of a fastener therethrough.

The clip can be configured such that the retention portion defines a substantially T-shaped (or I-shaped) cross-section or where the entirety of the clip defines a substantially J-shaped cross-section. In the T-shaped configuration, the plurality of walls define two retention channels, whereas in the J-shaped configuration, they define one channel. In the T-shaped configuration, a seal can be disposed at the substantial distal end of each of the retention portions. In addition, each of the two retention channels of the T-shaped clip are configured to secure substantially equal-sized parts of the insulation. The clip may further include one or more springs disposed along one of the plurality of walls. These springs can be formed in either of both of the panel-engaging portion or the channels. For example, a spring may be disposed along one of the walls that extends substantially parallel to the panel-engaging portion. The T-shaped clip can be made as either a one-piece (unitary) construction, or from multiple-piece construction; in the latter, at least one of the plurality of walls makes up a first piece, while another of the walls makes up a second piece. For the multiple-piece configuration, a locking mechanism may be included to facilitate a snap-fit between the first and second pieces. The locking mechanism may include a plurality of complementary teeth on respective surfaces of the first and second pieces.

The clip may be made from a variety of materials, including plastic, such as polyvinyl chloride (PVC) or related extrudable plastics. The seal may be made from a material that is pliant (flexible) relative to the material making up the remainder of the clip. This promotes a more secure fit with reduced likelihood of gap formation, especially when the insulation against which the seal engages is rigid. The position of the seal is such that when the insulation is placed within the clip, the seal is biased against the insulation, substantially eliminating the aforementioned gap and consequent airflow between the seal and insulation. In situations where the seal is made from a different extrudable material than the remainder of the clip, it may be configured such that it can be co-extruded with a corresponding one of the walls.

According to another aspect of the invention, an insulative assembly is disclosed. The assembly includes a panel, a layer of insulation configured to cover at least a portion of the panel, and first and second clips to secure the insulation to the panel. The first clip includes a first panel-engaging portion and a first retention portion coupled to the first panel-engaging portion similar to those described in the previous aspect. The second clip includes a second panel-engaging portion and a second retention portion, also similar to that previously described. Optionally, and as before, the panel is substantially planar. In addition, the first clip can be made substantially J-shaped, while the retention portion of the second clip can be made substantially T-shaped. At least one of the first clips can be attached to the panel such that its longitudinal dimension extends along a substantially horizontal dimension of the panel. In such case, two of the first clips can be placed such that one is disposed above the other on the panel. Moreover, the retention channels of the two first clips may be disposed in a facing relationship to one another, thereby forming a frame-like enclosure at the upper and lower end of the insulation. In addition, the first clips can also be placed with its longitudinal dimension along a substantially vertical dimension of the panel; such use of the first clips can promote lateral support of the insulation, especially in corners or endwalls formed by the panels. At least one of the second clips can be disposed on the panel with its longitudinal dimension along a substantially vertical dimension of the panel. In another option, the thickness of the second clip is slightly less than the first clip, thereby allowing the former to fit inside the latter.

According to yet another aspect of the invention, a method of forming an insulated panel is disclosed. The method includes providing a panel, attaching at least one clip to the panel, and placing insulation in a retention channel of the clip such that the insulation engages a seal defined in the channel. As previously discussed, the clip includes a panel-engaging portion defining a panel-engaging surface thereon and a retention portion coupled to the panel-engaging portion and configured to engage the insulation. By placing the insulation in the clip, a bias is effected between the seal and the insulation such that a secure fit between the two is formed. Also as previously discussed, the clip can be secured to the panel by adhesive, fasteners or related attachment schemes. As with the previous aspect, numerous clips may be used to secure the insulation to the panel. For example, the plurality of clips may include at least one substantially J-shaped clip and at least one clip with a substantially T-shaped retention portion.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals and in which.

DETAILED DESCRIPTION OF THE PREFERRED EMBODIMENTS

Figure 1:
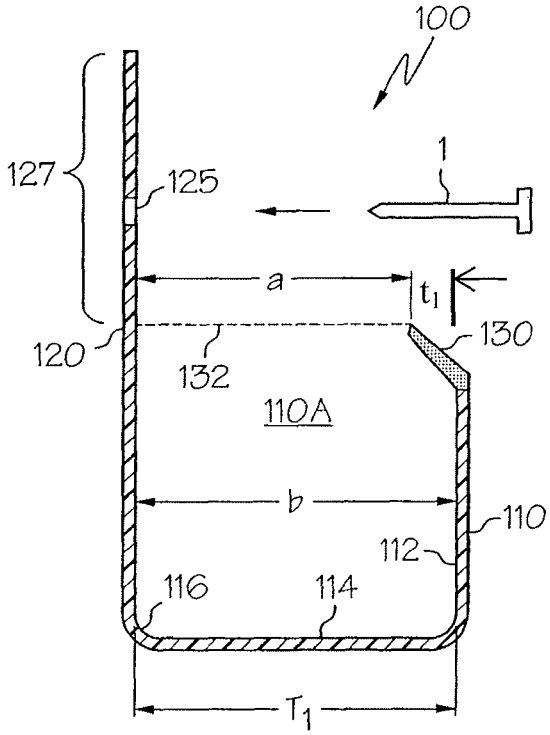
FIG. 1 illustrates a side view of an embodiment of a first clip according to an aspect of the present invention.

Referring first to FIG. 1, a clip 100 is substantially J-shaped such that it can support a workpiece (such as a piece of insulation) against a wall or related panel. Clip 100 defines a retention portion 110 (also known as a trough) to engage the workpiece, and an extending panel-engaging portion 120 for engagement of the support clip 100 to the wall. Retention portion 110 is made up of walls 112, 114 and connected to a portion of panel-engaging portion 120 at a proximal end 116 of retention portion 110 to define a retention channel 110A therebetween. The panel-engaging portion 120 extends beyond retention portion 110 with an extension 127 to facilitate connection of clip 100 to a wall surface. The elongate nature of the panel-engaging portion 120 with extension 127 is such that a user can easily insert a fastener 1 (such as a screw, nail, wall anchor, rivet or the like) through an optional aperture 125 defined in extension 127. Preferably, clip 100 is of one-piece construction, and is made of an easily-formable material, such as plastic. More preferably, the plastic is an extruded plastic. A seal 130 is disposed at the distal end of the trough, as shown by the end of wall 112 such that when the workpiece is placed inside retention channel 110A, the workpiece forms a close fit with the panel-engaging portion 120, the lower wall 114, and the edge formed by the seal 130. The seal 130 promotes a relatively tight fit between the workpiece and the clip 100 so that the flow of air between the workpiece and the generally planar surface to which the clip is mounted is significantly reduced. Efficacy of the seal 130 is enhanced when the workpiece is generally planar and relatively rigid. In a preferable (although not necessary) form, seal 130 is made of a material that is more pliant than that of the remainder of clip 100. For example, both could be made of plastic, where the plastic of seal 130 is more flexible than that of the panel-engaging portion or the remainder of retention portion 110. Clip 100 includes a substantially constant cross-section, such that it is amenable to rapid, low-cost production techniques, including extrusion. The seal 130 may be made from the same material as the remainder of clip 100, or made from a different material such that the two can be co-extruded.

Figure 2:
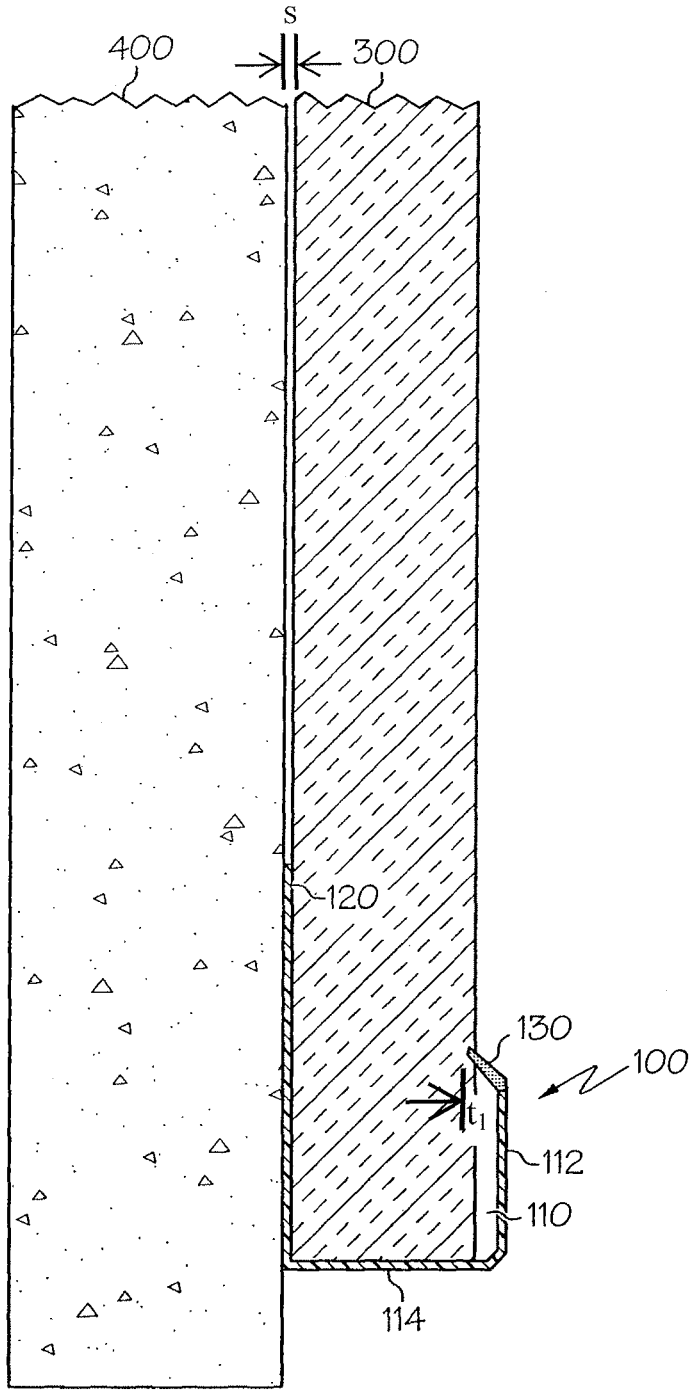
FIG. 2 illustrates the clip of FIG. 1 mounted to a wall panel and supporting a piece of insulation material.

Regardless of the nature of the material used to form the seal 130, the seal 130 is configured such that it defines a restricted channel entrance 132 along a longitudinal dimension of the retention channel 110A. More specifically, as is clearly illustrated in FIG. 1, the channel entrance 132 defines a channel access dimension a that is restricted relative to a parallel dimension b of a remaining portion of the retention channel 110A, such that (b-a) represents an extension distance $t_1$ of the seal 130 which, as is illustrated in FIG. 2, exceeds the spacing S that is defined between the insulation 300 and the wall panel 400. The I-shaped and T-shaped clips described below also define corresponding extension distances $t_2$ that exceed the spacing s, as is clearly illustrated in FIGS. 3A, 3B, 4, and 6. The insulative characteristics of a sheet of insulation held by the clip 100 are thus enhanced because the seal either defines a discrete contact surface with the insulative sheet or at least restricts the size of any gap between the clip 100 and the insulative sheet at the channel entrance 132.

Figure 5:
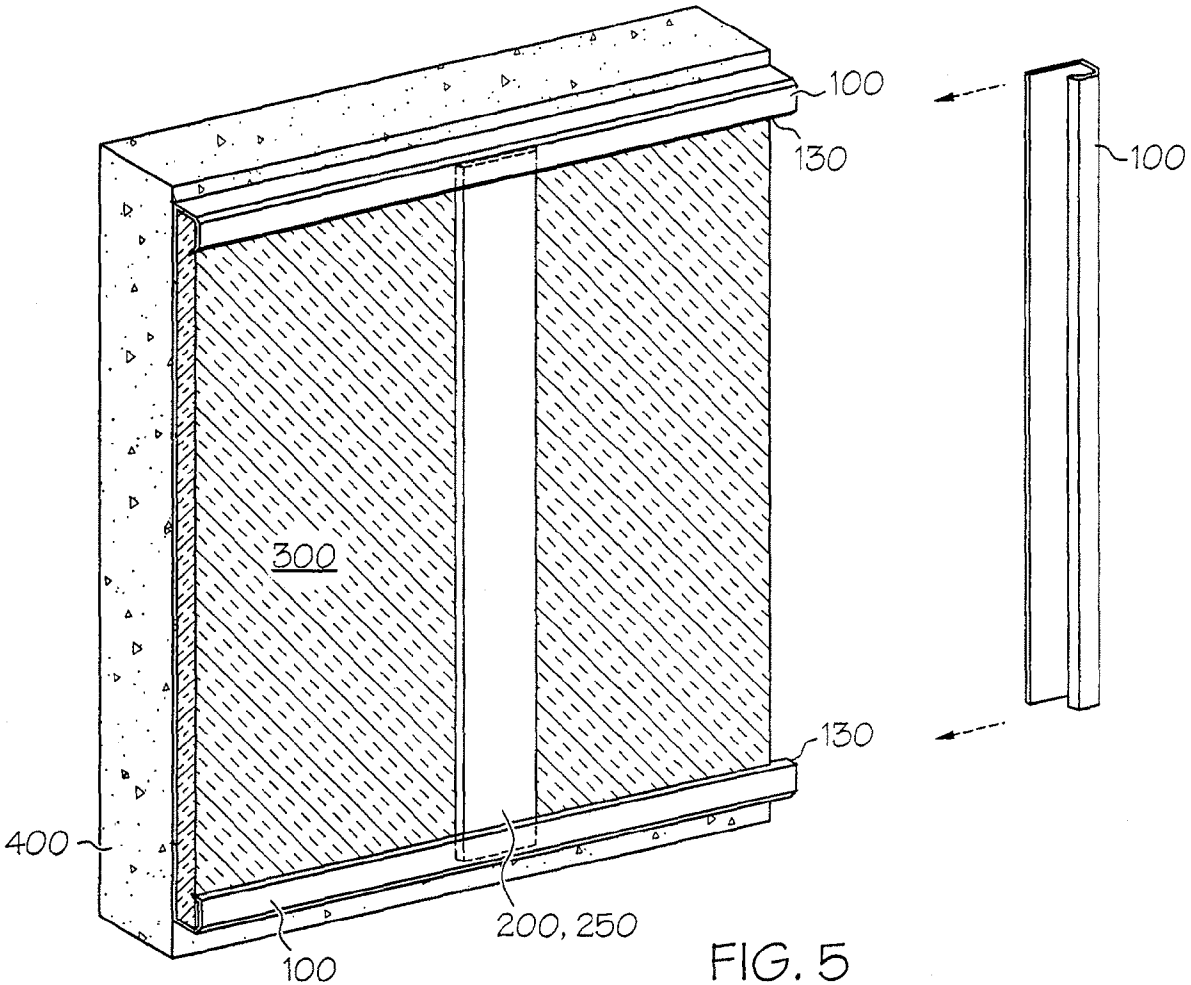
FIG. 5 illustrates a wall panel with an insulation sheet mounted to it using both the first and second clips according to an aspect of the present invention.

Referring next to FIG. 2, the relative engagement of insulation 300, support clip 100 and the wall panel 400 is shown, where the wall panel 400 is shown in a preferably vertical orientation. The connection between the clip 100 and wall panel 400 can be by any known means, such as adhesives or fasteners. In the event a fastener is used, the relatively exaggerated surface of panel-engaging portion 120 provides a suitable location through which the fastener may be placed. Seal 130 is preferably oriented such that defines a knife-edge along the seal's longitudinal dimension. As can be seen from the figure, the size of the clip 100 relative to the insulation 300, as well as the inwardly-projecting seal 130 is such that seal 130 forms a snug fit against a corresponding surface of the insulation 300. This snug fit further improves the insulative properties of the wall/insulation combination, as it cuts down on airflow around the insulation 300 that could otherwise lead to drafting and related circulation problems. By having the seal 130 be relatively compliant, it can be more conformally shaped against the insulation 300 to further reduce the likelihood of formation of gaps or related airflow passages. Support of insulation 300 along a downward direction is provided by trough 110, specifically its lower wall 114. Referring to FIG. 5, as clearly illustrated in the Figure, the plurality of insulation panels 300 have a major surface parallel to a surface of the wall 400.

Figure 6:
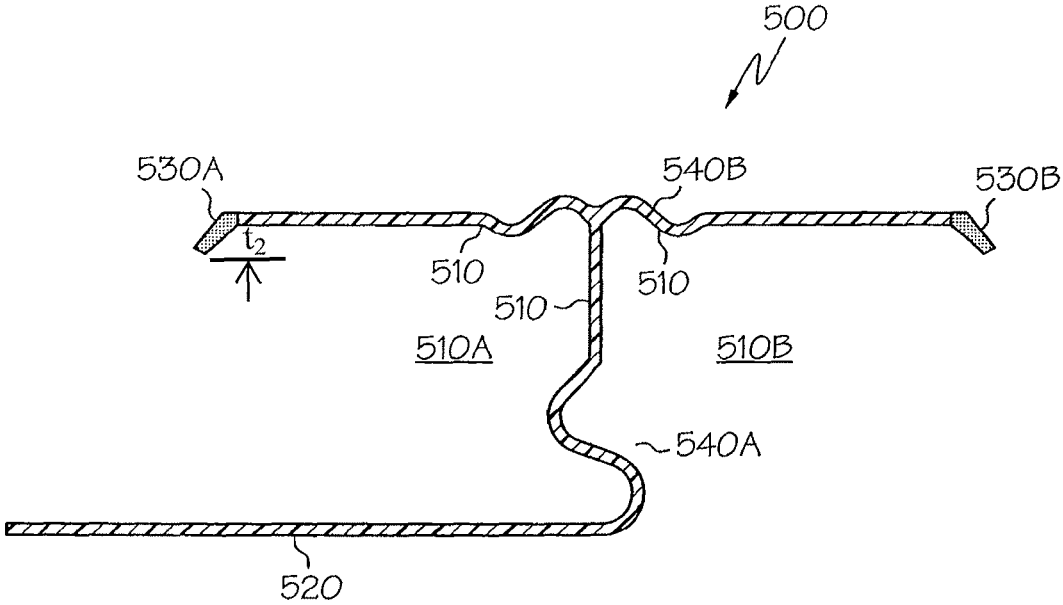
FIG. 6 illustrates a variation on the second clip depicted in FIG. 3A, including springs disposed in various channel walls.
Figure 3A:
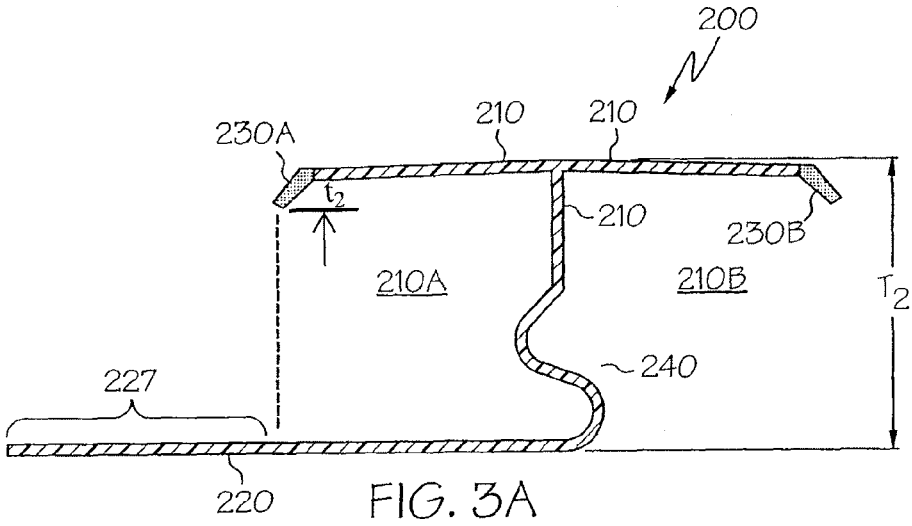
FIG. 3A illustrates a top view of an embodiment of a second clip.
Figure 3B:
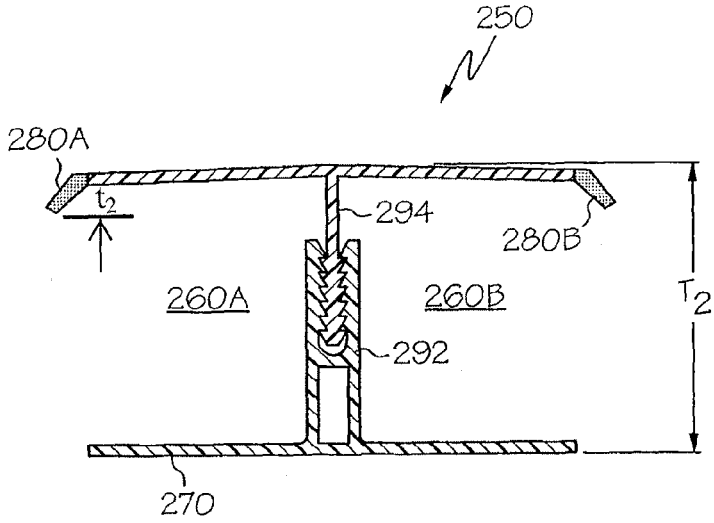
FIG. 3B illustrates a top view of an alternate embodiment of the second clip of FIG. 3A.

Referring next to FIGS. 3A, 3B and 6, variations 200 and 250 on a second clip are shown. Referring with particularity to FIG. 3A, one variation defines a substantially T-shaped retention portion 210 made up of a pair of retention channels 210A, 210B. In this variation, the clip 200 comprises a unitary structure where retention portion 210 is integrally formed with an elongate panel-engaging portion 220 along an S-shaped spring 240. In the present context, a structure is considered "unitary" when it is of one-piece construction. By way of example, a one-piece molded or extruded plastic component would be considered to exhibit unitary construction. Similarly, if the part includes co-extruded seals 230A, 230B (collectively seals 230), it is still of unitary construction, as the finished part has no components that are separately attached after the forming process. The inclusion of spring 240 allows the retention channels 210A, 210B to be elastically bent during insertion of the insulation, then snapped back into place afterwards. As with the J-shaped support clip 100, seals 230 disposed at the ends of each respective channel 210A and 210B are used to facilitate a snug fit between the insulation (not presently shown) and the clip 200. In addition, panel-engaging portion 220 includes an extension 227 that forms a base that can be mounted to a wall panel in a manner similar to that of support clip 100. Referring with particularity to FIG. 6, a further variation is shown on the unitary construction of the second clip, where panel-engaging portion 520 together with retention portion 510 (defined by channels 510A, 510B) makes up clip 500. In addition to previously shown and described spring 240 (shown presently as spring 540A) disposed on a generally vertical wall of retention portion 510, a second spring 540B is included on the generally horizontal wall that carries the and seals 530A, 530B. The addition of the second spring 540B provides additional clip compliance, further enabling insertion of a layer of insulation into the channels 510A, 510B.

Referring with particularity to FIG. 3B, another variation 250 of the second clip is substantially I-shaped such that it defines a retention portion 260 made up of a pair of retention channels 260A, 260B. Unlike the unitary construction of clip 200, adjoining clip 250 is of two-piece construction, where connection 290 between them is defined by a T-shaped male member 294 that can be secured to a substantially T-shaped female member 292. Panel-engaging portion 270 of female member 292 defines a base that is mountable to the surface of the wall panel (not presently shown). As with the previously-discussed variation, clip 250 includes seals 280 (shown corresponding to each respective channel as 260A and 260B) that are used to facilitate a snug fit between the insulation (not presently shown) and clip 250. Referring to FIG. 5, as clearly illustrated in the Figure, the co-extruded seals (not shown) of the I-shaped clip 250 engage a major face of the plurality of insulation panels 300.

Figure 4:
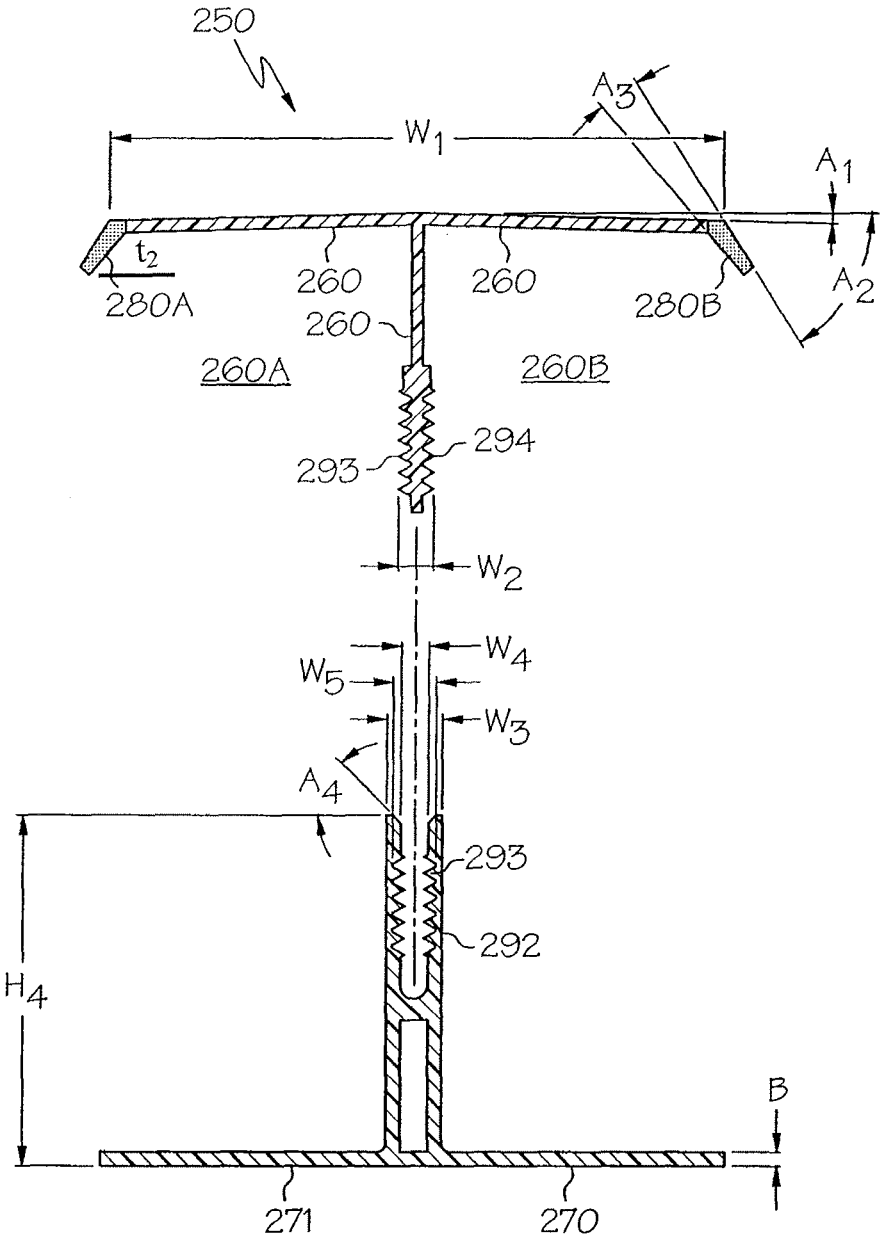
FIG. 4 illustrates an exploded view of the second clip of FIG. 3B.

Referring next to FIG. 4, the engagement of retention channels 260A, 260B to the panel-engaging portion 270 for clip 250 is shown. While the insertion of male member 294 into female member 292 could be effected by various means (such as a frictional pressing into place of the former to the latter), a more permanent connection can be established by using numerous prismatic retention members 293 disposed on corresponding surfaces of the members 294, 292 such that the prismatic retention members 293 are configured to define complementary snap-fit connection surfaces. The prismatic retention members 293 would resist separation from the complementary engaging surface once joined. Prismatic retention members 293 could be made from any suitable shape, of which triangular, saw-tooth or trapezoidal forms are examples. Preferably, but not necessarily, the relationship between the prismatic retention members 293 is such that a permanent lock can be formed. In the present context, a locking arrangement is considered "permanent" where the connection between two members is such that they cannot be separated without severely curtailing or disabling their subsequent connective properties.

Examples of dimensions of the clips 100, 200 and 250 (of which the latter is shown in FIG. 4), while capable of being adapted to any predetermined size (based on the application), are described in conjunction with FIG. 4. Overall width W1 of the top of the retention portion 260 is approximately two inches, with an overall height H1 of approximately seven-eights of an inch. The overall height H2 of the male member 294 is approximately thirteen-thirty seconds of an inch with the height H3 of each individual prismatic retention member 293 approximately three thirty-seconds of an inch. Furthermore, each individual prismatic retention member 293 has a width W2 of approximately three thirty seconds of an inch at its outer dimension, and a width W3 of approximately one-sixteenth of an inch at its inner dimension. The top of the retention portion 260 is angled A1 relative to a horizontal plane by approximately one degree. Seals 280A, 280B are angled A2 relative to the same horizontal plane by between one hundred and thirty five and one hundred and forty degrees. Height of the seals 280A, 280B is approximately five thirty-seconds of an inch, and includes an approximately thirteen degree taper angle A3 with a thickness at its narrow end of approximately one-thirty second of an inch. The panel-engaging portion 270 has an overall height H4 of approximately one and one-thirty second of an inch, with a thickness B of the horizontally-oriented base 271 of approximately one-sixteenth of an inch. The outer dimension width W3 of the female member 292 is approximately three-sixteenths of an inch, with an inner dimension width of the portion that receives the prismatic retention members 293 ranging from approximately one-sixteenth of an inch for the inner dimension W4, to approximately three-thirty seconds of an inch for the outer dimension W5. The angle A4 with which the opening of female member 292 makes with the horizontal plane is between sixty-five and seventy degrees, shown specifically in the figure as approximately sixty-nine degrees.

Referring to FIG. 5, in conjunction with FIGS. 1, 3A and 3B, it will be appreciated that the relative thickness dimensions T1 of first clip 100 and T2 of second clips 200, 250 is such that T1 is slightly greater than T2. Thus, in placing the clips onto wall panel 400, the second clips 200, 250 can be placed within first clip 100. The flexible nature of the material (such as the aforementioned PVC) making up clips 100, 200 and 250 facilitates the relative overlapping relationship between the clips. It will also be appreciated that while first clips 100 are shown in a generally horizontal orientation, they are also suitable for generally vertical mounting as shown such that they can substantially enclose the vertical edge of the insulation 300 that would otherwise be left exposed.

Referring to FIG. 5, as clearly illustrated in the Figure, the trough of one of the J-shaped clips 100 is provided on a bottom portion of the plurality of insulation panels 300 and the trough of another one of the J-shaped clips 100 is provided on a top portion of the plurality of insulation panels 300. A side portion of the insulation panel 300 is provided within one retention portion of the I-shaped clip 250. In one configuration, both ends of the I-shaped clip 250 extend vertically into the opposing trough portion of the at least two J-shaped clips 100.

Referring to FIG. 5, as clearly illustrated in the Figure, the co-extruded seal 130 of the J-shaped clips 100 engage the major face of the plurality of insulation panels 300.

Having described the invention in detail and by reference to preferred embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. An insulated wall assembly comprising a plurality of pre-cast panels, a plurality of insulation panels, at least two J-shaped clips, and at least one I-shaped snap-fit clip, wherein:

the plurality of pre-cast panels having adjacent vertical edges, the plurality of pre-cast panels being oriented such that the adjacent vertical edges thereof are in an abutting relationship to form a wall;

the at least two J-shaped clips each comprise a trough portion and a wall engaging portion;

the at least one I-shaped snap-fit clip comprises a male snap-fit member and a female snap-fit member that form two retention portions when joined, the two retention portions each comprising generally planar insulation panel contact surfaces configured to abut against edge surfaces of at least one of the plurality of insulation panels;

the female snap-fit member comprises a cavity defined by two opposite receiving surfaces connected by at least one lateral tensioning rib;

the lateral tensioning rib is spaced from two wall engaging portions of the at least one I-shaped snap-fit clip;

the wall engaging portion of the at least two J-shaped clips defines a generally planar wall-engaging surface capable of attaching to the wall;

the two wall engaging portions of the at least one I-shaped snap-fit clip each define a generally planar wall-engaging surface capable of attaching to the wall;

the trough portion of the at least two J-shaped cups comprises at least one pliant integral co-extruded seal extending away from a distal edge of the trough portion in an angled configuration;

each of the two retention portions of the at least one I-shaped snap-fit clip comprises at least one pliant integral co-extruded seal extending away from a distal edge of one of the two retention portions in an angled configuration;

the longitudinal dimensions of the at least two J-shaped clips extend along a horizontal dimension of the plurality of insulation panels;

the longitudinal dimension of the at least one I-shaped snap-fit clip extends along a vertical dimension of the plurality of insulation panels;

the trough portion of one of the at least two J-shaped clips is provided on a bottom portion of the plurality of insulation panels and the trough portion of another one of the at least two J-shaped clips is provided on a top portion of the plurality of insulation panels as opposing trough portions;

the at least one I-shaped snap-fit clip having a first and second end, wherein the first and second end of the at least one I-shaped snap-fit clip extend vertically into the opposing trough portions of the at least two J-shaped clips;

a side portion of one of the plurality of insulation panels is provided within one of the two retention portions of the at least one I-shaped snap-fit clip;

the plurality of insulation panels have major surfaces parallel to a surface of the wall;

the co-extruded seals of the at least one I-shaped snap-fit clip engage the major faces of the plurality of insulation panels; and the co-extruded seal of the at least two J-shaped clips engages the major faces of the plurality insulation panels.

2. The insulated wall assembly of claim 1, wherein the at least two J-shaped clips is are of unitary construction.

3. The insulated wall assembly of claim 1, wherein the wall-engaging portions of the at least two J-shaped clips and the at least one I-shaped snap-fit clip are elongate relative to the two retention portions of the at least one I-shaped snap-fit clip, defining an attachment-receiving tab such that a substantially outward-facing normal projection from a surface on said attachment-receiving tab does not intersect said wall.

4. The insulated wall assembly of claim 3, wherein said attachment-receiving tab is configured to receive a fastener therethrough, said attachment-receiving tab extending a sufficient amount to facilitate substantially unimpeded access of said fastener to said at least one I-shaped snap-fit clip to retain said at least one I-shaped snap-fit dip on said wall.

5. The insulated wall assembly of claim 4, wherein said attachment-receiving tab defines an aperture therein.

6. The insulated wall assembly of claim 1, wherein the at least one I-shaped snap-fit clip further comprises a locking mechanism configured to facilitate a snap-ht between a male snap-fit member and a female snap-fit member of a multiple-piece construction.

7. The insulated wall assembly of claim 6, wherein said locking mechanism defines a plurality of complementary teeth on respective surfaces of said male snap-fit member and female snap-fit member of said multiple-piece construction.

8. The insulated wall assembly of claim 1, wherein the at least two J-shaped clips and at least one I-shaped snap-fit clip are made of plastic.

9. The insulated wall assembly of claim 1, wherein at east one of the plurality of insulation panels are in contact with the insulation panel contact surfaces of the at least one I-shaped snap-fit cap.

10. The insulated wall assembly of claim 1, further comprising adhesive between at least one of the plurality of insulation panels and the at least one I-shaped snap-fit clip.

11. The insulated wall assembly of claim 1, wherein the male snap-fit member comprises upper flanges positioned in an angled configuration with respect to the wall engaging portions of the at least one shaped snap-ft snap-fit clip.

12. The insulated wall assembly of claim 1, wherein the lateral tensioning rib is positioned a distance generally ⅓ the total length of the two opposite receiving surfaces from the wall engaging portions.

13. The insulated wall assembly of claim 1, wherein the lateral tensioning rib has a non-linear profile.

* * * * *